United States Patent [19]

Johnson

[11] 3,981,122

[45] Sept. 21, 1976

[54] APPARATUS FOR APPLYING ADHESIVE TO CARTON FLAPS

[75] Inventor: Lloyd D. Johnson, Portland, Conn.

[73] Assignee: Emhart Industries, Inc., Hartford, Conn.

[22] Filed: Dec. 8, 1975

[21] Appl. No.: 638,770

[52] U.S. Cl. ..... 53/374; 53/383; 93/36 MM; 118/DIG. 3; 118/411

[51] Int. Cl.[2] ..... B65B 7/20

[58] Field of Search ..... 53/374, 383; 93/36 MM; 118/411, DIG. 3

[56] References Cited

UNITED STATES PATENTS

| | | | |
|---|---|---|---|
| 2,691,260 | 10/1954 | Schlemmer | 53/383 X |
| 3,587,209 | 6/1971 | Arentz | 53/374 |

*Primary Examiner*—Travis S. McGehee
*Attorney, Agent, or Firm*—McCormick, Paulding & Huber

[57] ABSTRACT

Erected cartons are fed downstream on a dead plate by the various flight bars of a flight bar conveyor system, and between upper and lower pairs of side guides which are adjustable both laterally to accommodate cartons of various widths. Plows associated with the side guides preposition the closure flaps of the cartons so that each of these flaps is received in a slot of an adhesive applying head so that bands or strips of adhesive are applied to these flaps. The adhesive applying heads are uniquely mounted in that they are conveniently prepositioned for accommodating the flaps when the side guides are adjusted to the width of the carton. Two such heads are pivotally mounted in a block provided on the longitudinal center line of the machine, with a link being provided between each adhesive applying head and the side guide structure. In one version this link is slidably received in its associated adhesive applying head so as to permit movement of the head along the link in order to automatically vary the angle of the head to accommodate cartons of various widths.

6 Claims, 6 Drawing Figures

APPARATUS FOR APPLYING ADHESIVE TO CARTON FLAPS

CROSS REFERENCE TO RELATED APPLICATION

This application is identical in its disclosure to application Serial No. 638,769 with the same title filed concurrently herewith by Thomas L Flanagan.

BACKGROUND OF THE INVENTION

Prior art adhesive, or "cold glue" applying mechanisms for use in apparatus of the type currently used to apply glue or adhesive, to the project closure flaps of an erected carton, generally require that these flaps be moved outwardly with respect to the longitudinal plane or center line of the machine, and outwardly of the generally vertical plane defined by the side panels to which these closure flaps are connected. For example, U.S. Pat. No. 3,088,433 to Walter et al illustrates such a configuration wherein the longitudinally extending closure flaps associated with the side panels of the carton are moved at a very substantial angle to project outwardly generally normal to the side panels in order to be received in glue applying structure provided well outside of the path of movement of the side panels. This particular geometry requires an apparatus having a considerable dimension or width in the transverse direction, with the actual width of the apparatus being variable when one considers the fact that such a machine must be set up to accommodate cartons of various widths.

U.S. Pat. No. 3,879,922 issued to Dadarian illustrates another prior art approach wherein the flaps are opened through substantial angles, greater than 90°, in order to be received in critically located glue applying heads mounted on a structure which must be prepositioned quite accurately, not only in relation to the center line of the machine, but also in relationship to the side guides for guiding the erected carton on its path through the machine.

The present invention has for its primary object the handling of an erected carton wherein the projecting closure flaps are moved through only a very slight angle and only as necessary to accommodate cartons of various widths, the glue or adhesive applying heads being pivotally mounted adjacent the center line of the machine and in one version at least being so mounted as to be automatically prepositioned to accommodate the carton flaps of a particular carton merely by prepositioning the side guides to accommodate that particular size carton in the machine.

SUMMARY OF THE INVENTION

This invention relates generally to machines for handling erected cartons and deals more particularly with a mechanism for applying adhesive to the projecting side flaps of the carton without the usual necessity for moving these side flaps through substantial angles as for example to cause the side flaps to project outwardly and normally from the plane of the side panels of the carton as the carton progresses through the machine.

In its presently preferred form, the present invention resides in an apparatus for handling cartons in a flight bar conveyor system utilizing a dead plate and various flights for feeding cartons individually and in a continuous fashion through the machine. Side guides are provided for guiding the carton through the machine, and flap positioning means is provided for orienting the flaps at predetermined angles related to the lateral dimension of the carton, but in any event 90° or less as measured with respect to the plane defined by the fold lines between the flaps and the side panels. Adhesive applying heads are provided with slots for receiving the said flaps at said predetermined angles, and these heads are supported from a pivot block provided on the longitudinal center line of the machine. Means is provided for pivoting these adhesive applying heads with respect to said block in order to vary the angular orientation of the associated slots. In one version of the invention, the actual angle of the slot in the adhesive applying head is achieved through means closely related to the lateral adjustment of the side guides, and in another version the angular adjustment of the adhesive applying head is achieved automatically and in direct proportion to the adjustment of these side guides.

Figure 1:
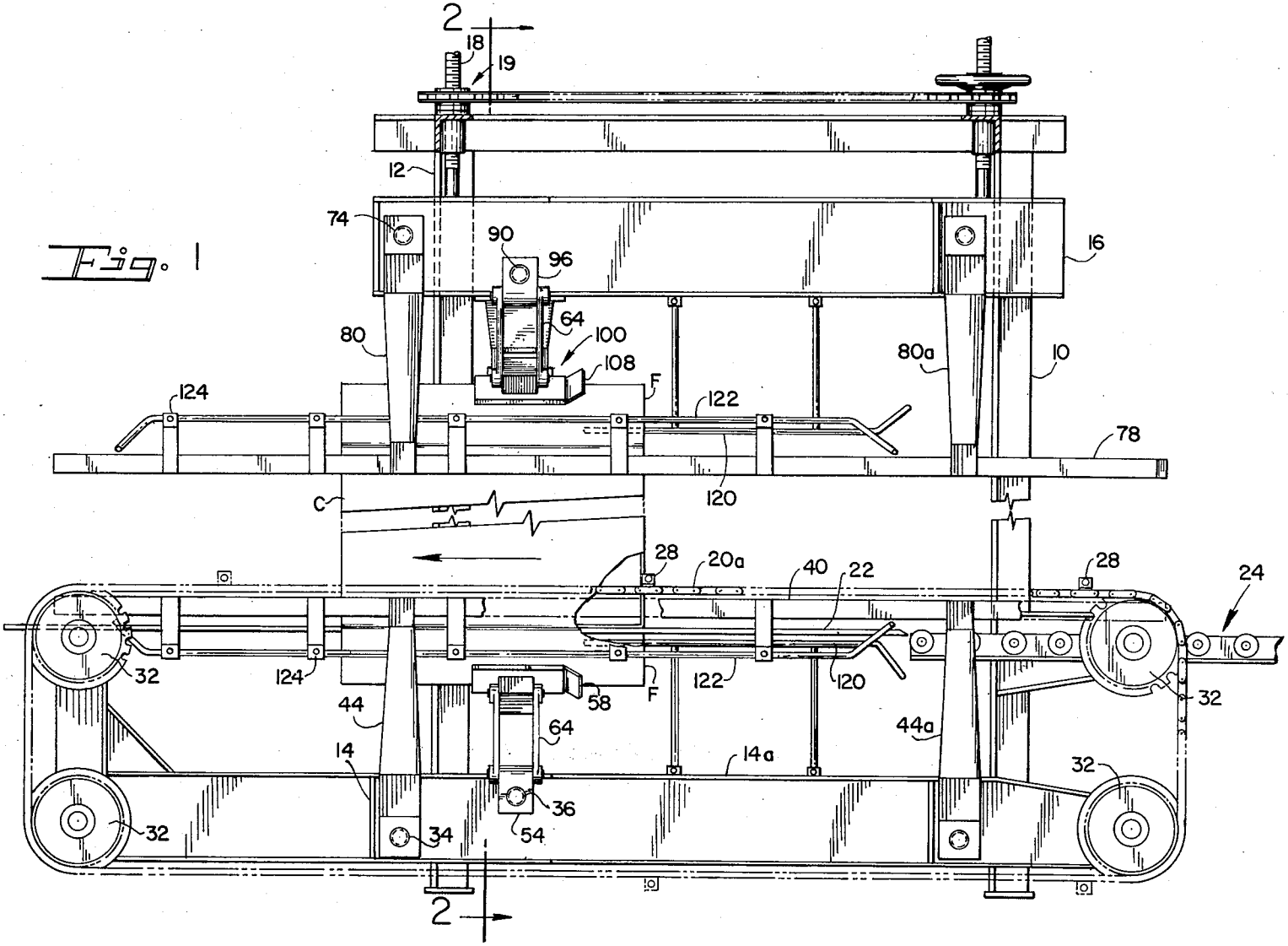
FIG. 1 is a vertical sectional view with portions broken away of an adhesive applying improvement in an apparatus for handling erected cartons as they are fed individually from right to left through the machine.
Figure 2:
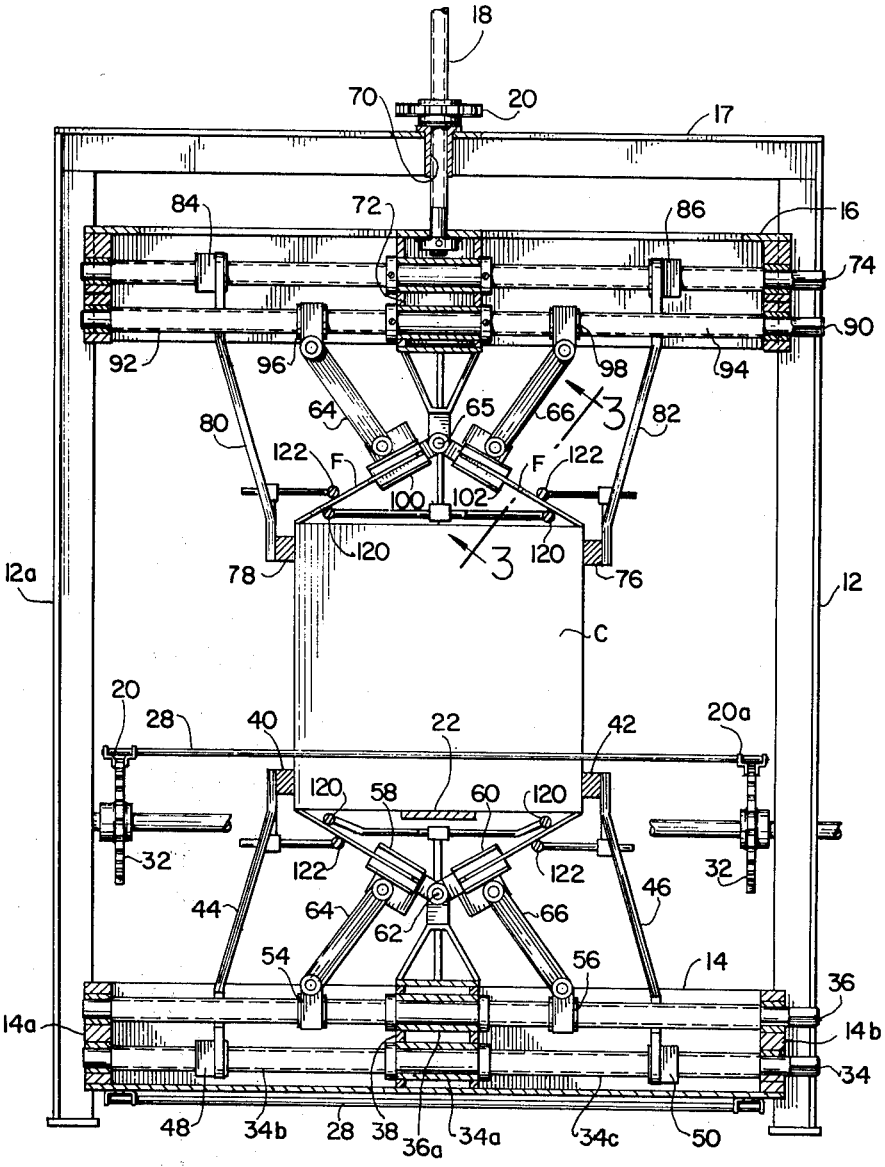
FIG. 2 is a vertical sectional view with portions broken away taken generally on the line z—2 of FIG. 1.

DETAILED DESCRIPTION OF THE FIRST EMBODIMENT SHOWN IN FIGS. 1 AND 2 OF THE DRAWINGS

Turning now the drawings in greater detail, FIG. 1 shows a machine having a fixed frame including upright members 10 and 12, of which there are four, two being provided at the upstream end of the machine, and two at the downstream end as best shown in FIG. 2 at 12 and 12*a*. The machine further includes a lower frame 14, and an upper frame 16, certain portions of which frames are quite similar to one another in that the machine is adapted to handle cartons having closure flaps at both its lower and upper ends are best shown in FIG. 2. Still with reference to the fixed frame of the machine, an upper cross beam 17 extends across and between the downstream posts 12 and 12*a* and a generally vertical extending adjustment screw 18 is rotatably and threadably received in a nut 70 defined centrally of the cross beam 17 generally on the center line of the machine so that rotation of the screw 18, in response to movement of the chain 19, is adapted to achieve vertical movement of the upper frame 16 either upwardly or downwardly to accommodate cartons of various height. The lower frame 14 is not so adjustable, and remains fixed in the machine frame and also fixed with respect to the dead plate 22 along which the cartons are adapted to be fed as they move from right to left through the machine in FIG. 1.

The flight bar conveyor system receives cartons fed into the upstream or right hand end portion of the machine from the roller conveyor 24. The flight bar conveyor system includes an upper run having flight bars 28 provided thereon for engaging and moving each of the cartons individually and accelerating these cartons off the roller conveyor 24 so that the cartons are separated from one another to be handled by the adhesive applying devices to be described. The flight bar conveyor system comprises laterally spaced chains 20, 20*a* entrained over two sets of four sprockets 32, 32 each. One of these sprockets is driven by suitable drive means (not shown), and at least one set of corresponding sprockets has a common shaft so that both chains are driven from a single such drive means.

The lower frame 14 of the machine is preferably fixed to the uprights 10 and 12 by channel members 14*a* and 14*b* and member 14 houses adjustment screws 34 and 36, both of which adjustment screws are journalled adjacent their intermediate portions 34*a* and 36*a* respectively in a fixed block 38 provided in said lower frame 14. The lower adjustment screw 34 includes left and right hand threaded segments, 34*b* and 34*c* respectively, and the end portions of these segments are journalled in the fixed lower frame 14 as indicated generally at 14*a* and 14*b*.

Means is provided for controlling the lateral position of the carton C as it is conveyed through the machine, and preferably said means comprises side guides 40 and 42 which side guides are supported by projecting arms 44 and 46 respectively. Actually, two such sets of supporting arms comprise portions of a side guide supporting structure best shown in FIG. 1 at 44 and 44*a*. The lower ends of these supporting arms 44 and 46 comprise left and right hand threaded nut portions, 48 and 50, so that rotation of the adjustment screw 34 in a clockwise or counterclockwise direction results in movement of the side guide structure toward and away from the center line of the machine in order to accommodate cartons of various widths.

Still with reference to the lower frame structure 14, another adjusting screw 36 is provided, and is generally similar in construction to the adjusting screw 34 just described. The screw 36 also includes left and right hand threaded segments located to either side of the center line of the machine, each of which threaded segments carries correspondingly threaded nuts, 54 and 56, such that these nuts can also be moved toward and away from one another in order to accommodate cartons of various size. It is an important feature of this version of the present invention that rotation of the adjustment screw 36 provides angular adjustment for two adhesive applying heads, 58 and 60, which heads are pivotally mounted in the fixed block 38 for angular movement in equal but opposite directions of the axis of pivot pin 62. Two links, 64 and 66, pivotally connect each of the adhesive applying heads, 58 and 60 respectively, to associated nuts, 54 and 56 respectively. Thus, although two adjustment screws, 34 and 36, are provided in the lower frame 14 of the machine, it will be apparent that a predetermined degree of rotation associated with each of these lead screws will achieve a desired degree of lateral movement for the associated side guide supporting structures 40 and 42 and also a desired degree of angular movement of the adhesive applying heads, 58 and 60, which movements will be directly related to one another and thereby provide an improved degree of control over the adhesive applying devices used to apply adhesive to the projecting closure flaps associated with the side panels of the cartons C as it passes through the machine.

Turning next to a more detailed description of the mechanism associated with the upper frame 16, said upper frame 16 is adjustably mounted vertically in the fixed frame of the machine through the threaded shaft 18. The said shaft 18 is threadably mounted in the nut defining structure 70 provided for this purpose in the cross beam 17, and the lower end of the screw 18 is rotatably mounted in a block assembly, indicated generally at 72 in FIG. 2. An adjustment screw 74, generally similar to the screw 34 described previously with respect to the lower side guide structure 40 and 42, is provided in the upper frame 16 for achieving lateral movement of the upper side guides 76 and 78 toward and away from one another and toward and away from the center line of the machine itself. More particularly this screw 74 moves the side guides 76 and 78 toward and away from the block assembly 72 referred to previously. Thus, the upper side guide structure 76 and 78 comprises the depending arms 80 and 82, corresponding to the arms 44 and 46 associated with the lower side guide structure, and the upper ends of these arms 80 and 82, includes threaded nut portions, 84 and 86 respectively, which nut portions are in turn threadably received on oppositely threaded segments of the adjusting screw 74.

Still with reference to the upper frame structure 16, a second adjusting screw 90 is also provided with left and right hand threaded segments 92 and 94 such that correspondingly threaded nuts 96 and 98 are adapted to be moved toward and away from one another, in corresponding relationship to the lateral movement of the side guide structure, in order to vary the angular relationship of the upper adhesive applying heads 100 and 102. These heads are connected to their associated nuts by links, 64 and 66, identical to the links described hereinabove with reference to the lower adhesive applying heads, 58 and 60.

It will be apparent that the flap F must be oriented at the desired angular position to be received in the funnel shaped structure 108 of FIG. 1, and it is a feature of the version of the invention depicted in FIG. 1 that means is provided for either lifting the flap F to this position or moving the flap downwardly into the correct orientation so as to be accepted by the glue head 100. Said means comprises the guide rail 122 mounted to the side guide structure 78, and the guide rail 120 mounted to the upper frame 16. Similar flap guiding structure is provided from the lower side guide rail 40 or frame 14 but has been omitted for clarity. So too, downstream of the adhesive applying heads, suitable flap guiding bars, such as that shown at 124 in FIG. 1 are preferably provided. However, these guide rails need not be described in detail with reference to FIGS. 1 and 2 as they are of generally conventional construction. The upstream end of the frame 16 also includes a flap tucker, or kicker arm, (not shown) which is oscillated in timed relationship to movement of the cartons through the machine to fold the non-glued rear closure flaps of the carton. A fixed plow (not shown) folds the front closure flap in a conventional manner, and as described in greater detail in the above mentioned prior art U.S. Pat. No. 3,088,433 issued to Walter et al.

DETAILED DESCRIPTION OF FIGS. 3 AND 4

Figure 3:
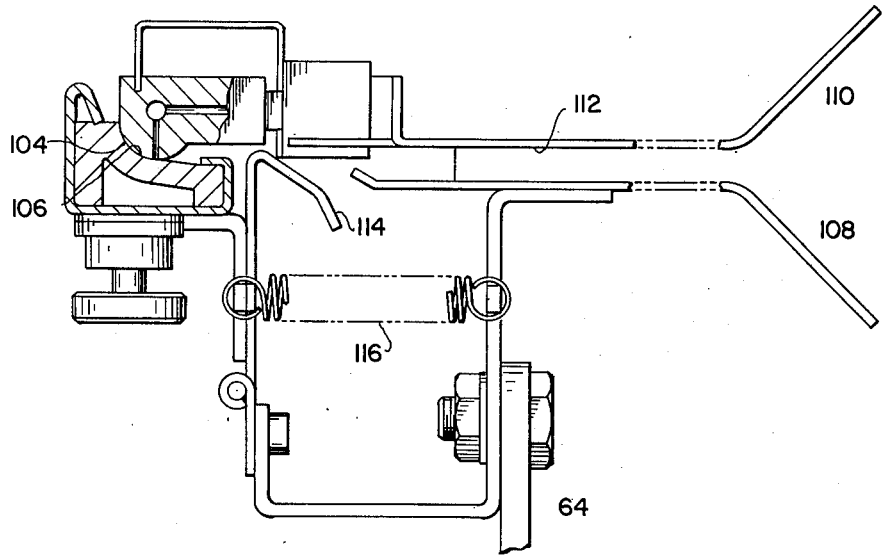
FIG. 3 is a sectional view taken generally on the line 3—3 of FIG. 2, but drawn to a somewhat larger scale, and illustrates the adhesive applying device in its inactive position, without any flap being glued.
Figure 4:
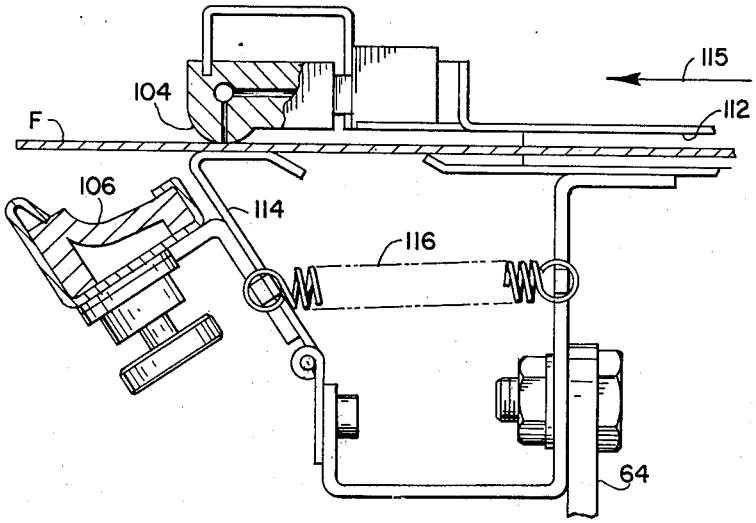
FIG. 4 is a view similar to FIG. 3 but illustrating the adhesive applying head in its active position, that is for applying adhesive to a closure flap as it moves through the slot in the associated head.

Turning next to a more detailed description of the adhesive applying heads, FIGS. 3 and 4 show one of these heads, with FIG. 3 illustrating the device in an inactive position wherein the glue applying nozzle portion 104 rests against a wet pad 106, such that no adhesive flows through the nozzle 104, and so that the moisture from the pad is continuously available at the nozzle in order to prevent clogging of its openings. The link 64, which pivotally supports the head, is indicated in FIGS. 3 and 4 and guide means, 108 and 110, are provided for guiding the flap to be glued through the associated slot 112 in the head. The direction of movement of the flap to be glued is indicated generally by the arrow 115 in FIG. 4, and the flap itself is indicated generally at F in this view. It will be apparent that the flap itself causes pivotal movement of a gate 114 such that the moisture applying pad 106 is retracted out of the way in order to provide contact between the nozzle 104 and the flap F whenever a flap has moved through the slot 112. A spring 116 is provided for urging the pad 106 back to the inactive position illustrated in FIG. 3. The actual head construction depicted in FIGS. 3 and 4 has been shown and described in some detail but it will be apparent that any cold glue applicator head might be adapted for use with the present invention. The important feature of the head resides in the fact that it is pivotally mounted to an associated block such that the angular orientation of its associated slot is adapted to receive a flap F in a precisely determined angular orientation such that the angle of the flap is 90° or less and preferably not significantly different from the angle of the flap as it approaches the apparatus from the roller conveyor 24.

FIG. 1 shows the upper and lower adhesive applying heads 58 and 100 in their active positions, that is for applying adhesive to the flap F, and it also shows the line 64 which connects the head 100 to its associated threaded nut 96 on the adjustment screw 90. The lower adhesive applying head 58 is similarly supported as best shown in FIG. 1 by the link 64 and associated nut 54 together with the associated adjustment screw 36 in the lower frame 14.

Figure 5:
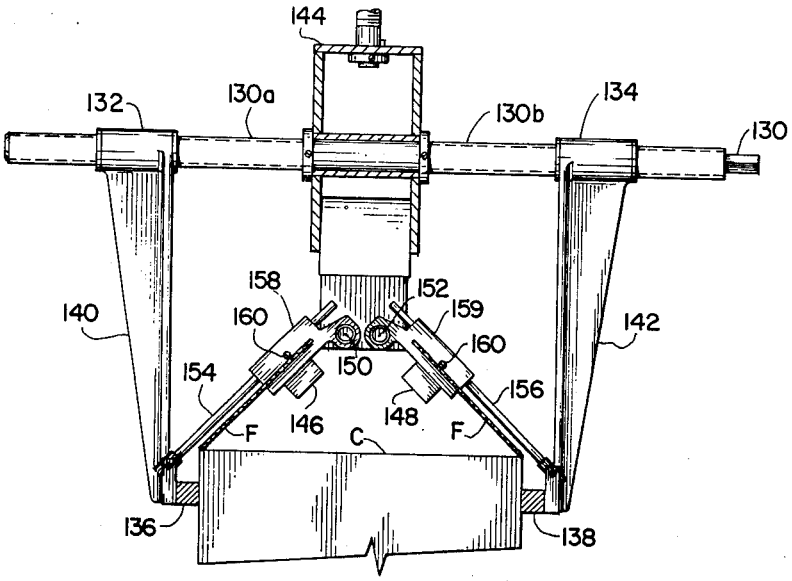
FIG. 5 is a vertical sectional view of an upper portion of an apparatus similar in many respects to that of FIGS. 1 and 2 but comprises an alternative version of the present invention.
Figure 6:
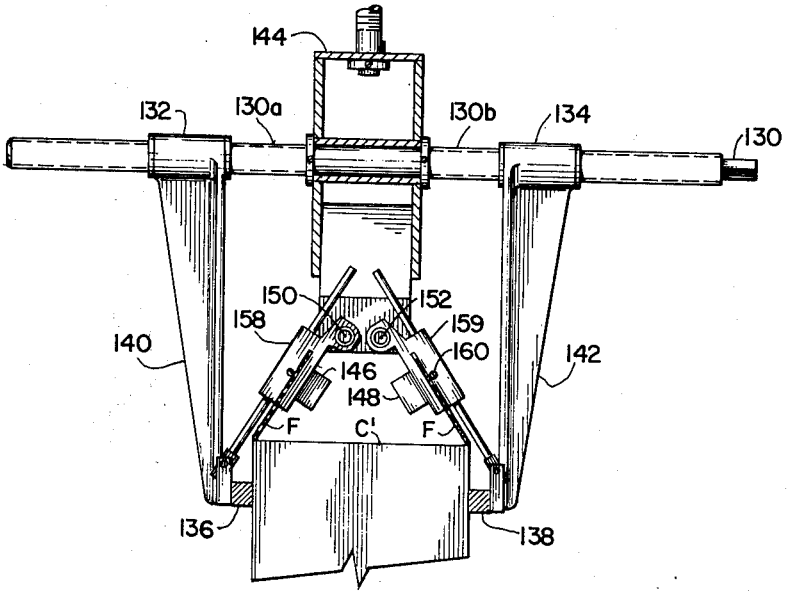
FIG. 6 is a view similar to FIG. 5 but showing the configuration of certain movable parts when cartons of somewhat narrower width are to be accommodated.

DETAILED DESCRIPTION OF THE SECOND PREFERRED EMBODIMENT SHOWN IN FIGS. 5 AND 6 OF THE DRAWINGS

Turning now to a more detailed description of the alternative version of the present invention dipicted in FIGS. 5 and 6, it is noted that portions of the apparatus depicted in FIGS. 1 and 2 have been omitted from FIGS. 5 and 6 because of the fact that this alternative version also includes a flight bar conveyor system for receiving erected cartons from a roller conveyor or the like, and also includes means for positioning, or orienting the flaps associated with the side panels of such cartons at predetermined equal but opposite angles of 90° or less as measured with respect to the plane defined by the fold lines associated with the pivotal connection between the closure flaps and said side panels. Adhesive applying heads are also utilized in this alternative version and may be similar to those described hereinabove with reference to FIGS. 3 and 4. The support means for the adhesive applying heads is similar in some respects to the heads mentioned previously with reference to the first embodiment, but the means for adjustably mounting these heads so as to vary the angular position of the slots in these heads which receive the flaps of the carton does differ substantially from the previous embodiment and will be described in detail.

Considering FIG. 5 in greater detail, a laterally extending adjustment screw 130 is rotatably supported in a vertically adjustable upper frame, generally similar to the frame 16 described hereinabove with reference to FIG. 1. The screw 130 includes left and right hand threaded segments **130*a* and 130*b* respectively, each of which segments carries a correspondingly threaded nuts 132 and 134 respectively. The said nuts 132 and 134 comprise portions of the side guide supporting structure associated with guiding the carton C, as it passes in the downstream direction through the machine. The side guide structure includes longitudinally extending rails 136 and 138 provided at the lower end portions of the arms 140 and 142, respectively, and the upper portions of the arms 140 and 142 define the nuts 132 and 134 respectively. Actually, upstream and downstream sets of such side guide supporting arms in a manner generally similar to that described hereinabove with reference to the arms 80 and 80*a*** of FIG. 1.

Although portions of the upper frame 16 of the version of the present invention depicted in FIGS. 1 and 2 has been omitted from FIG. 5 for clarity, the centrally located block assembly 144 has been shown in FIG. 5 and is generally similar to the block assembly 72 described hereinabove with reference to FIG. 2. However, only one lead screw 130 is utilized in the version described with reference to FIG. 5, the need for a second adjusting screw, such as that shown and described hereinabove with reference to the first embodiment of the present invention, is not required in this improved version of FIG. 5. Instead of providing the adhesive applying heads in a system which requires a separate adjusting screw, as described hereinabove with reference to the screw 90, the heads 146 and 148 are adjustably positioned on their associated pivot pins 150 and 152 by means of the links 154 and 156 respectively. These links are each pivotally connected adjacent their lower ends to the side guide rails 136 and 138 and the upper ends of these links are slidably received in openings or bores provided for this purpose in the ashesive applying head structures, 146 and 148 respectively.

The links, 154 and 156, serve somewhat the same function as do the links, 64 and 66 associated with the FIG. 2 version of the present invention, FIG. 5 shows the links 154 and 156 pivotally connected only at their lower ends, and the upper ends of these links are slidably connected to the associated adhesive applying heads so that the links can vary in length in order to accommodate different angular relationships of the flaps as required on cartons C, C of various width. For example, FIG. 6 shows a carton C′ of significantly narrower lateral dimension than the carton C of FIG. 5, and also shows the side guides 136 and 138 positioned closer to one another than is the case in FIG. 5 in order to properly guide the narrower carton C′ through the machine so that it remains on the center line of the machine as it moves downstream. This prepositioning of the side guides is accomplished through the screw 130 by reason of the oppositely threaded nuts, 132 and 134, of the side guide supporting structure 140 and 142. The links 154 and 156 are shows as being oriented at a steeper angle in FIG. 6 in order to accommodate a carton C′ of smaller size. When cartons of larger size are accommodated, these links, 154 and 156, are automatically moved toward one another, pivoting about the axis defined by the pivotal connection between the lower ends of the links and the side guides 136 and 138, with the result that the flaps F, F are oriented at an angle of 90° or less with respect to the horizontal even as the side guides are located by the adjusting screw 130.

A still further distinction between the version shown in FIGS. 5 and 6 over that described hereinabove with reference to FIGS. 1 and 2 caan be attributed to the fact that each of the individual adhesive applying heads is pivotally mounted to the block assembly 144 on its own associated pivot, 150 and 152 respectively, rather than being mounted to such block assembly for movement about a single pivot axis defined by a single pivot as indicated generally at 65 in FIG. 2. This lateral spacing of the pivots associated with the individual adhesive applying heads permits cartons of a wide variety of widths to be accommodated in an apparatus which requires only slight angular movement of the flaps F, F in the apparatus of FIGS. 5 and 6.

Still with reference to the FIG. 5 version a guide rod 160 extends in the upstream direction and cooperates with the funnel-shaped guide 108 and 110 described hereinabove with reference to FIG. 3. It is a further feature of the embodiment of the invention shown in FIGS. 5 and 6 that this guide 160 is conveniently mounted directly on the structure 158 associated with the adhesive applying head itself in order to properly guide the flap as the flap moves into the slot defined in the adhesive applying head 146. As mentioned previously, the adhesive applying head itself comprises a conventional element of the combination disclosed herein and while the head 146 as well as the head 148 illustrated in FIGS. 5 and 6 preferably are generally similar to that described hereinabove with reference to FIGS. 3 and 4, they might instead comprise known structure equivalent thereto. The improvement disclosed herein both with respect to the embodiment of FIGS. 5 and 6, as well as that depicted in FIGS. 1 and 2, relates to the means for supporting these heads so that they are adjustably mounted in a convenient manner, on in a manner whereby they are automatically adjusted in direct proportion to the preadjustment required of the side guide structure.

I claim:

1. In an apparatus for feeding erected cartons in a downstream longitudinal direction, said cartons having side panels with closure flaps pivotally connected thereto on laterally spaced longitudinally extending fold lines aligned with the downstream direction, the improvement comprising:

a. positioning means for orienting said flaps at predetermined equal but opposite angles of 90° or less measured with respect to the plane defined by the fold lines, b. adhesive applying heads having guides for receiving and applying a band of adhesive to said flaps oriented at said predetermined angles, c. support means for said adhesive applying heads, including a pivot block on the longitudinal center line of the apparatus for pivotally supporting said heads, d. said support means further including at least two links each of which links has one end connected to one of said heads, e. means for adjustably mounting the other end of both said links for movement toward and away from said block to vary the angular position of said slots in said heads to accommodate the flaps of cartons having a lateral dimension between said fold lines which can vary, the smaller size cartons having their flaps oriented at steeper angles and larger cartons at shallower angles, the adhesive applying heads being movable only angularly relative to said block, f. side guide structure for engaging said carton side panels.

g. said means for adjustably mounting the other ends of said links including at least one laterally extending shaft having right hand and left hand threaded portions, and correspondingly threaded nuts to which said other ends of said links are pivotally connected to achieve said movement toward and away from said block, and h. said left and right hand threaded nuts also comprising a portion of said guide structure whereby the side guides are moved toward and away from one another in the same amount as movement of said other ends of said links.

2. Apparatus according to claim 1 wherein said block on said apparatus center line defines two laterally spaced pivots, one pivot for each of said adhesive applying heads.

3. Apparatus according to claim 1 wherein said one end of each of said links is slidably connected to its associated adhesive applying head to allow movement of said adhesive applying head along said link and radially with respect to the pivot axis defined by said pivotal connection at the other end of said link.

4. Apparatus according to claim 3 wherein said block on said apparatus center line defines two laterally spaced pivots, one pivot for each of said adhesive applying heads.

5. Apparatus according to claim 3 wherein the other end of each of said links is pivotally connected to said side guide structure so that said link is oriented generally parallel to the flap to be glued at said predetermined angle.

6. Apparatus according to claim 1 further characterized by a flight bar conveyor for feeding erected cartons downstream, a dead plate on the longitudinal center line for supporting the cartons at a desired height relative to the active run of the conveyor flight bars, a fixed frame, and means for adjusting the vertical position of said block on the apparatus center line.

* * * * *

UNITED STATES PATENT OFFICE

CERTIFICATE OF CORRECTION

Patent No. 3,981,122 Dated September 21, 1976

Inventor(s) Lloyd D. Johnson

It is certified that error appears in the above-identified patent and that said Letters Patent are hereby corrected as shown below:

Column 2, line 26, "z-2" should be --2-2--.

Column 2, line 37, "comprises" should be --comprising--.

Column 2, line 55, "are" should be --as--.

Column 5, line 39, "line" should be --link--.

Column 6, line 20, after "arms" insert --are provided--.

Column 7, line 9, "caan" should be --can--.

Column 8, line 28, after "said" insert --side--.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*